US005887598A

United States Patent [19]

Oliver et al.

[11] Patent Number: 5,887,598

[45] Date of Patent: Mar. 30, 1999

[54] NAIL CARE TOOL SYSTEM

[76] Inventors: Joe Oliver; Sutinthong Oliver, both of 4516 W. Northstate Dr., Apt. 350, Irving, Tex. 75062

[21] Appl. No.: 116,126

[22] Filed: Jul. 15, 1998

[51] Int. Cl.[6] ..... A45D 29/05; A45D 29/18

[52] U.S. Cl. ..... 132/73.6; 132/73.5

[58] Field of Search ..... 132/73.6, 75.6, 132/75.8, 73.5; 451/356, 163, 164

[56] References Cited

U.S. PATENT DOCUMENTS

| | | | |
|---|---|---|---|
| 1,246,958 | 11/1917 | Lindsey | 132/73.6 |
| 1,472,876 | 11/1923 | Larrus et al. | 132/73.6 |
| 1,848,864 | 3/1932 | Andis | 132/73.6 |
| 2,597,525 | 5/1952 | Kessler | 132/75.8 |
| 3,169,536 | 2/1965 | Caracciolo, Sr. | 132/73.6 |
| 3,216,034 | 11/1965 | Johnson | 15/23 |
| 3,311,117 | 3/1967 | Thompson | 132/73.6 |
| 3,420,250 | 1/1969 | Holmes | 132/73.6 |
| 3,754,556 | 8/1973 | Watkins | 132/73.6 |
| 4,016,890 | 4/1977 | Fiorenza., Sr. et al. | 132/75.6 |
| 4,117,854 | 10/1978 | Rosenbloom | 132/75.8 |
| 4,137,926 | 2/1979 | Pao | 132/73.6 |
| 5,033,485 | 7/1991 | Hauerwas et al. | 132/73.6 |
| 5,125,422 | 6/1992 | Cheung et al. | 132/73.6 |

*Primary Examiner*—John J. Wilson
*Assistant Examiner*—Trang Doan
*Attorney, Agent, or Firm*—Joseph N. Breaux

[57] ABSTRACT

A nail care tool system that includes a rechargeable drive unit, a dual element tool head that includes a sanding belt and a rotary drive socket, at least one rotary shaping tool detachable connectable to the rotary drive socket, and a sanding belt cover that is positionable over a portion of the dual element tool head to cover the sanding belt; the rechargeable drive unit including a drive unit housing having a connector lip that detachably secures the rechargeable drive unit to the dual element tool head, a rechargeable battery housed within the drive unit housing, a drive motor in electrical connection with the rechargeable battery, and a drive gear mounted to an output shaft of the drive motor and positioned exteriorly of the drive unit housing; the dual element tool head including a tool head housing having a component compartment formed therein, a drive unit drive gear receiving aperture formed through the tool head housing, a driven gear rotatably mounted within the component compartment, a sanding belt drive wheel in rigid connection with the driven gear, a rotary drive socket head extending from a sanding belt return guide wheel, a sanding belt tensioning assembly including two spring biased tensioning wheels, and a sanding bell that is looped over the sanding belt drive wheel, the sanding belt return guide wheel and the two spring biased tensioning wheels of the sanding belt tensioning assembly.

1 Claim, 2 Drawing Sheets

NAIL CARE TOOL SYSTEM

TECHNICAL FIELD

The present invention relates to nail care tools and more particularly to a nail care tool system that includes a rechargeable drive unit, a dual element toot head that includes a sanding belt and a rotary drive socket, at least one rotary shaping tool detachable connectable to the rotary drive socket, and a sanding belt cover that is positionable over a portion of the dual element tool head to cover the sanding belt; and wherein the rechargeable drive unit includes a drive unit housing having a connector lip that detachably secures the rechargeable drive unit to the dual element tool head, a rechargeable battery housed within the drive unit housing, a drive motor in electrical connection with the rechargeable battery, and a drive gear mounted to an output shaft of the drive motor and positioned exteriorly of the drive unit housing; the dual element tool head includes a tool head housing having a component compartment formed therein, a drive unit drive gear receiving aperture formed through the tool head housing, a driven gear rotatable mounted within the component compartment, a sanding belt drive wheel in rigid connection with the driven gear, a rotary drive socket head extending from a sanding belt return guide wheel, a sanding belt tensioning assembly including two spring biased tensioning wheels, and a sanding belt that is looped over the sanding belt drive wheel, the sanding belt return guide wheel and the two spring biased tensioning wheels of the sanding belt tensioning assembly; the at least one rotary shaping tool includes a tool shaft sized to lockably fit within a shaft receiving socket cavity of the rotary drive socket head; and the sanding belt cover includes a notch formed into the cover sidewall thereof sized and positioned to receiving the rotary drive socket head.

BACKGROUND OF INVENTION

Shaping, polishing and otherwise caring for nails can require a considerable amount of cutting, sanding and polishing. It would of course be a benefit to have a nail care system that included at least two electrically powered nail shaping/polishing mechanisms that can be used at the discretion of the nail care professional to accomplish a variety of nail care procedures. Because in some instances, it can be beneficial to have a nail shaping mechanism that can be used to shape relatively large areas, it would be a benefit to have a nail care tool system that included a sanding belt as one of two electrically powered nail shaping mechanisms. Because in other instances, it can be beneficial to have a nail shaping mechanism that can be used to polish or shape relatively small areas, it would be a benefit to have a nail care tool system that included a rotary drive for detachably attaching relatively small rotary polishing elements. It would of course also be a benefit to have a nail care tool system that included both a sanding belt and a rotary drive for rotary polishing elements.

SUMMARY OF INVENTION

It is thus an object of the invention to provide a nail care tool system that nail care system that includes at least two electrically powered nail shaping/polishing mechanisms.

It is a further object of the invention to provide a nail care tool system that includes a sanding belt as one of two electrically powered nail shaping mechanisms.

It is a still further object of the invention to provide a nail care tool system that includes a rotary drive for detachably attaching relatively small rotary polishing elements.

It is a still further object of the invention to provide a nail care tool system that includes a rechargeable drive unit, a dual element tool head that includes a sanding belt and a rotary drive socket, at least one rotary shaping tool detachably connected to the rotary drive socket, and a sanding belt cover that is positionable over a portion of the dual element tool head to cover the sanding belt; and wherein the rechargeable drive unit includes a drive unit housing having a connector lip that detachably secures the rechargeable drive unit to the dual element tool head, a rechargeable battery housed within the drive unit housing, a drive motor in electrical connection with the rechargeable battery, and a drive gear mounted to an output shaft of the drive motor and positioned exteriorly of the drive unit housing; the dual element tool head includes a tool head housing having a component compartment formed therein, a drive unit drive gear receiving aperture formed through the tool head housing, a driven gear rotatably mounted within the component compartment, a sanding belt drive wheel in rigid connection with the driven gear, a rotary drive socket head extending from a sanding belt return guide wheel, a sanding belt tensioning assembly including two spring biased tensioning wheels, and a sanding belt that is looped over the sanding belt drive wheel, the sanding belt return guide wheel and the two spring biased tensioning wheels of the sanding belt tensioning assembly; the at least one rotary shaping tool includes a tool shaft sized to lockably fit within a shaft receiving socket cavity of the rotary drive socket head; and the sanding belt cover includes a notch formed into the cover sidewall thereof sized and positioned to receiving the rotary drive socket head.

It is a still further object of the invention to provide a nail care tool system that accomplishes all or some of the above objects in combination.

Accordingly, a nail care tool system is provided. The nail care tool system includes a rechargeable drive unit, a dual element tool head that includes a sanding belt and a rotary drive socket, at least one rotary shaping tool detachably connected to the rotary drive socket, and a sanding belt cover that is positionable over a portion of the dual element tool head to cover the sanding belt; the rechargeable drive unit including a drive unit housing having a connector lip that detachably secures the rechargeable drive unit to the dual element tool head, a rechargeable battery housed within the drive unit housing, a drive motor in electrical connection with the rechargeable battery, and a drive gear mounted to an output shaft of the drive motor and positioned exteriorly of the drive unit housing; the dual element tool head including a tool head housing having a component compartment formed therein, a drive unit drive gear receiving aperture formed through the tool head housing, a driven gear rotatably mounted within the component compartment, a sanding belt drive wheel in rigid connection with the driven gear, a rotary drive socket head extending from a sanding belt return guide wheel, a sanding belt tensioning assembly including two spring biased tensioning wheels, and a sanding belt that is looped over the sanding belt drive wheel, the sanding belt return guide wheel and the two spring biased tensioning wheels of the sanding belt tensioning assembly; the at least one rotary shaping tool including a tool shaft sized to lockably fit within a shaft receiving socket cavity of the rotary drive socket head; and the sanding belt cover including a notch formed into the cover sidewall thereof sized and positioned to receiving the rotary drive socket head.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY EMBODIMENTS

Figure 1:
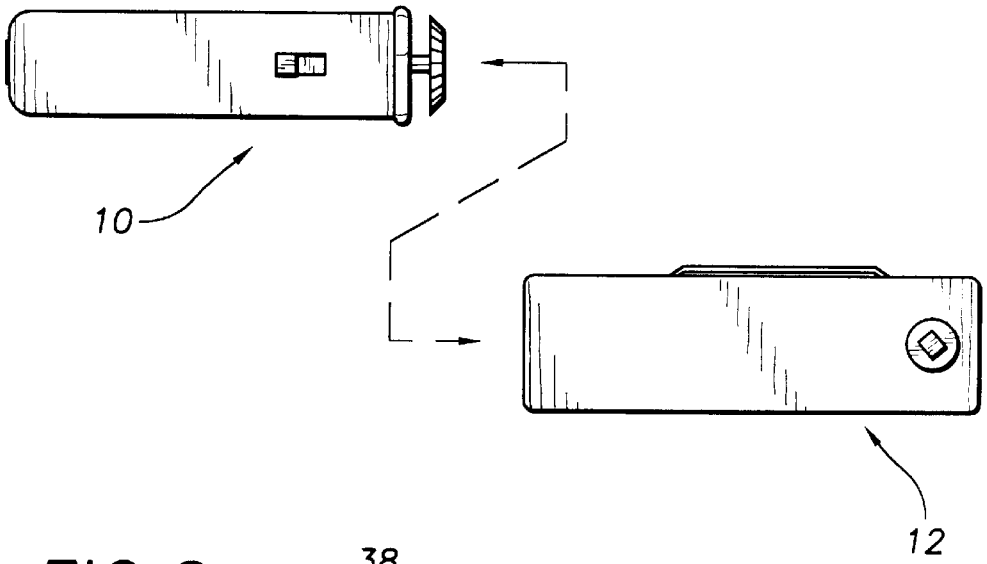
FIG. 1 is an exploded plan view showing exemplary embodiments of the rechargeable drive unit and the dual element tool head of the nail care tool system of the present invention.
Figure 2:
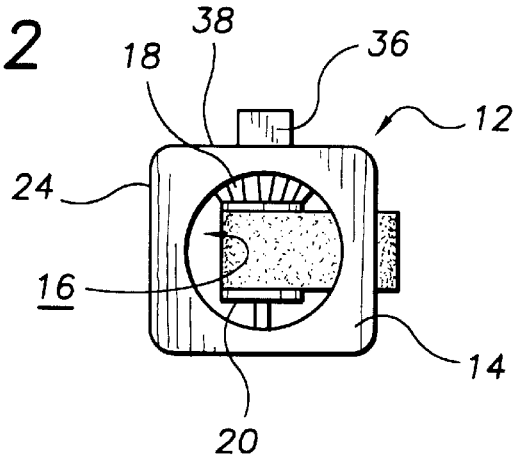
FIG. 2 is a plan view of the drive unit connecting end of an second exemplary dual element tool head of the nail care tool system of the present invention showing the circular drive unit drive gear receiving aperture, the driven gear of the dual element tool head in connection with the sanding belt drive wheel, and the rotary drive socket head extending through the sidewall of the tool head housing of the dual element tool head.

FIG. 1 shows exemplary embodiments of the rechargeable drive unit, generally designated 10, and the dual element tool head, generally designated 12, of the nail care tool system of the present invention. With reference to FIG. 2, duel element tool head 12 includes a drive unit connecting end 14 that is provided with a circular drive unit drive gear receiving aperture, generally designated 16, into which a portion of rechargeable drive unit 10 is inserted when connecting rechargeable drive unit 10 and dual element tool head 12.

Figure 3:
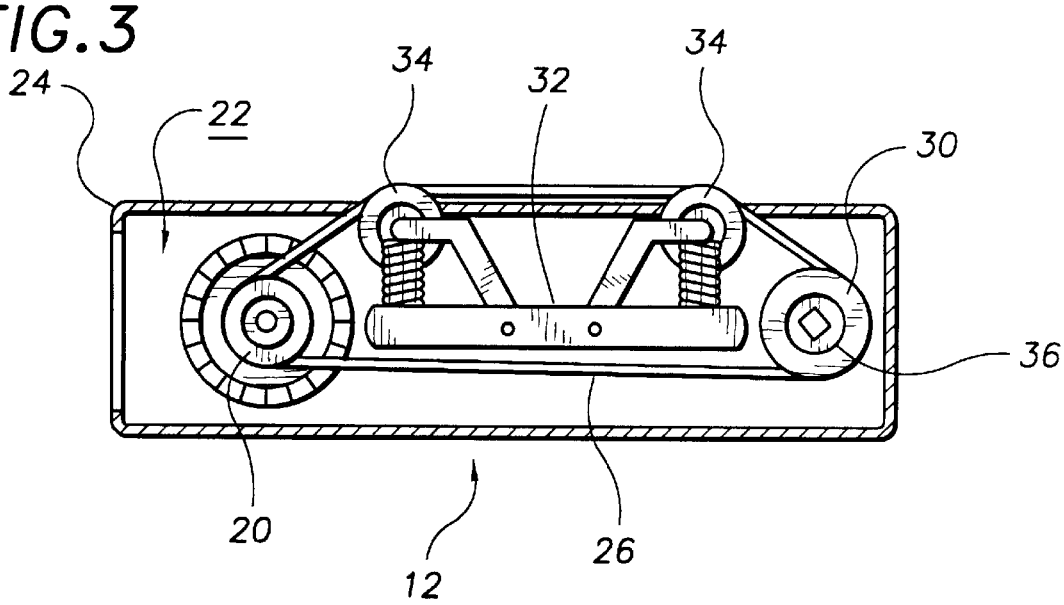
FIG. 3 is a cross sectional view of the dual element tool head of FIG. 1 with the facing sidewall of the tool head housing removed to show the component compartment, the drive unit drive gear receiving aperture, the driven gear of the dual element tool head in connection with the sanding belt drive wheel, the rotary drive socket head extending from the sanding belt return guide wheel, the sanding belt tensioning assembly including two spring biased tensioning wheels, and the sanding belt looped over the sanding belt drive wheel, the sanding belt return guide wheel and the two spring biased tensioning wheels of the sanding belt tensioning assembly.

Dual element tool head 12 includes a driven gear 18 that is integrally formed within a sanding belt drive wheel 20. With reference to FIG. 3, sanding belt drive wheel 20 is rotatably mounted within a component compartment 22 that is formed within a molded plastic tool head housing 24. During assembly, a closed loop sanding belt 26 is looped around sanding belt drive wheel 20, a sanding belt return guide wheel 30 and a sanding belt tensioning assembly, generally designated 32, that includes two spring biased tensioning wheels 34. A rotary drive socket head 36 is integrally formed with and extends from sanding belt return guide wheel 30. With reference back to FIG. 2, rotary drive socket head 36 extends out past a sidewall 38 of tool head housing 24.

Figure 4:
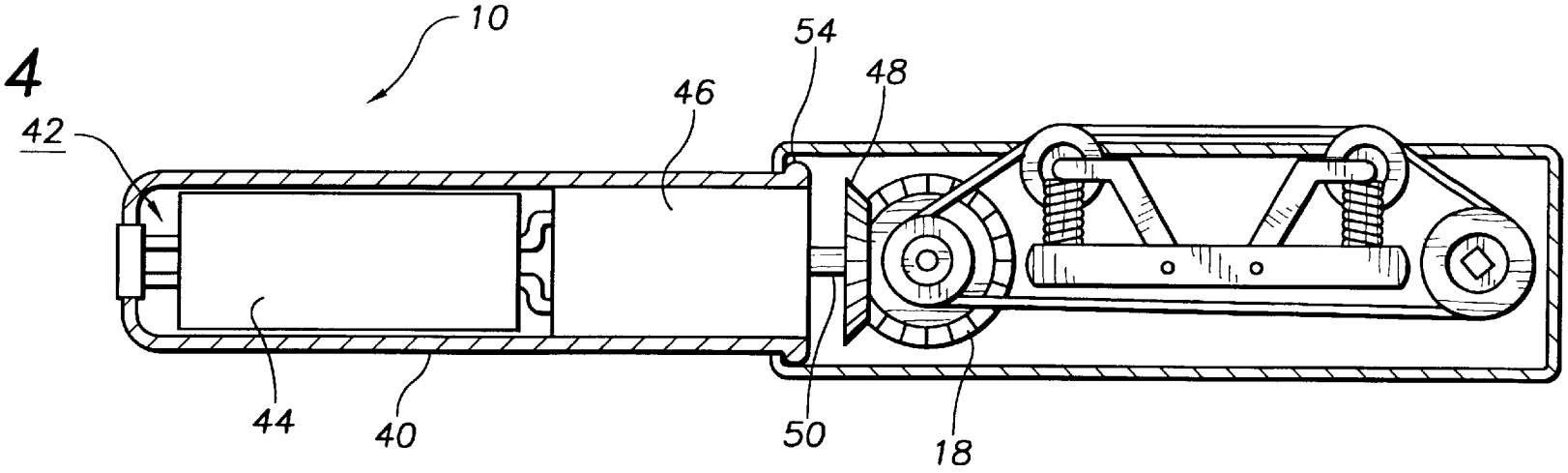
FIG. 4 is a cross sectional view of the rechargeable drive unit and the dual element tool head of the nail care tool system of FIG. 1 showing the rechargeable battery, the drive motor, the drive gear, and the connector lip of the rechargeable drive unit; and the driven gear of the dual element tool head in connection with drive gear of the rechargeable drive unit.

With reference now to FIG. 4, rechargeable drive unit 10 includes a molded plastic drive unit housing 40 having a housing compartment 42 therein containing a rechargeable battery 44 and an electric drive motor 46. A nylon drive gear 48 is mounted on the output shaft 50 of drive motor 46. Nylon drive gear 48 meshes with driven gear 18 when a connecting lip 54 is inserted through and past circular drive unit drive gear receiving aperture 16 (FIG. 2).

Figure 5:
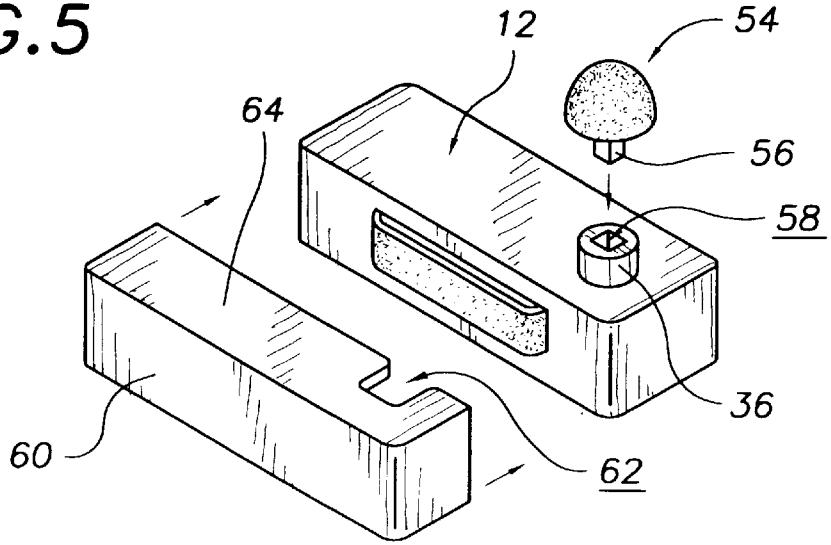
FIG. 5 is a partially exploded perspective view, of the dual element tool head of the nail care tool system of FIG. 2 showing an exemplary rotary shaping tool and an exemplary sanding belt cover that is positionable over the sanding belt when it is desired to use the rotary shaping function of the dual element tool head.

With reference to FIG. 5, in this embodiment, the tool system includes a cone shaped rotary shaping tool 54 that includes a tool shaft 56 sized and shaped to lockably fit within a shaft receiving socket cavity 58 of rotary drive socket head 36; and a sanding belt cover 60 that includes a notch 62 formed into a cover sidewall 64 thereof that is sized and positioned to receiving the rotary drive socket head 36.

It can be seen from the preceding description that a nail care tool system has been provided that includes at least two electrically powered nail shaping/polishing mechanisms; that includes a sanding belt as one of two electrically powered nail shaping mechanisms; that includes a rotary drive for detachably attaching relatively small rotary polishing elements; and that includes a rechargeable drive unit, a dual element tool head that includes a sanding belt and a rotary drive socket, at least one rotary shaping tool detachable connectable to the rotary drive socket, and a sanding belt cover that is positionable over a portion of the dual element tool head to cover the sanding belt; and wherein the rechargeable drive unit includes a drive unit housing having a connector lip that detachably secures the rechargeable drive unit to the dual element tool head, a rechargeable battery housed within the drive unit housing, a drive motor in electrical connection with the rechargeable battery, and a drive gear mounted to an output shaft of the drive motor and positioned exteriorly of the drive unit housing; the dual element tool head includes a tool head housing having a component compartment formed therein, a drive unit drive gear receiving aperture formed through the tool head housing, a driven gear rotatably mounted within the component compartment, a sanding belt drive wheel in rigid connection with the driven gear, a rotary drive socket head extending from a sanding belt return guide wheel, a sanding belt tensioning assembly including two spring biased tensioning wheels, and a sanding belt that is looped over the sanding belt drive wheel, the sanding belt return guide wheel and the two spring biased tensioning wheels of the sanding belt tensioning assembly; the at least one rotary shaping tool includes a tool shaft sized to lockably fit within a shaft receiving socket cavity of the rotary drive socket head; and the sanding belt cover includes a notch formed into the cover sidewall thereof sized and positioned to receiving the rotary drive socket head.

It is noted that the embodiment of the nail care tool system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A nail care tool system comprising:

a rechargeable drive unit;

a dual element tool head that includes a sanding belt and a rotary drive socket;

at least one rotary shaping tool detachably connected to said rotary drive socket; and a sanding belt cover that is positionable over a portion of said dual element tool head to cover said sanding belt;

said rechargeable drive unit including a drive unit housing having a connector lip that detachably secures said rechargeable drive unit to said dual element tool head, a rechargeable battery housed within said drive unit housing, a drive motor in electrical connection with said rechargeable battery, and a drive gear mounted to an output shaft of said drive motor and positioned exteriorly of said drive unit housing;

said dual element tool head including a tool head housing having a component compartment formed therein, a drive unit drive gear receiving aperture formed through said tool head housing, a driven gear rotatably mounted within said component compartment, a sanding belt drive wheel in rigid connection with said driven gear, a rotary drive socket head extending from a sanding belt return guide wheel, a sanding belt tensioning assembly including two spring biased tensioning wheels, and a sanding belt that is looped over said sanding belt drive wheel, said sanding belt return guide wheel and said two spring biased tensioning wheels of said sanding belt tensioning assembly;

said at least one rotary shaping tool including a tool shaft sized to lockably fit within a shaft receiving socket cavity of said rotary drive socket head;

said sanding belt cover including a notch formed into said cover sidewall thereof sized and positioned to receiving said rotary drive socket head.

* * * * *